US006289625B1

(12) United States Patent
Phares

(10) Patent No.: US 6,289,625 B1
(45) Date of Patent: Sep. 18, 2001

(54) GUN SCOPE OVERLAY DEVICE

(76) Inventor: Mark G. Phares, Rte. #2 Box #308, Elkins, WV (US) 26241

( * ) Notice: Subject to any disclaimer, the term of this patent is extended or adjusted under 35 U.S.C. 154(b) by 0 days.

(21) Appl. No.: 09/602,040

(22) Filed: Jun. 23, 2000

(51) Int. Cl.[7] ..... F41G 3/00; F41G 1/38

(52) U.S. Cl. ..... 42/119; 42/129; 42/130; 42/111

(58) Field of Search ..... 42/106, 111, 113, 42/119, 122, 125, 124, 130, 140, 129, 131, 123

(56) References Cited

U.S. PATENT DOCUMENTS

| | | | | |
|---|---|---|---|---|
| D. 48,618 | | 2/1916 | Stimpson . | |
| D. 296,838 | | 7/1988 | Diaz . | |
| D. 403,774 | | 1/1999 | Laughlin et al. . | |
| 1,869,385 | | 8/1932 | Maish . | |
| 2,889,629 | * | 6/1959 | Darkenwald | 33/50 |
| 3,131,477 | * | 5/1964 | Thomas | 33/50 |
| 3,744,133 | * | 7/1973 | Fukushima et al. | 33/234 |
| 4,718,962 | | 1/1988 | Goodwin . | |
| 4,896,581 | | 1/1990 | Cole . | |
| 5,495,676 | * | 3/1996 | Chesnut et al. | 33/244 |
| 5,561,563 | * | 10/1996 | Chesnut et al. | 359/823 |

* cited by examiner

*Primary Examiner*—Charles T. Jordan
*Assistant Examiner*—Kimberly Smith

(57) ABSTRACT

A gun scope overlay device for diminishing the parallax affect when using a gun scope. The gun scope overlay device includes a panel. The panel has a front side and a back side. The panel is substantially transparent. The panel has a generally circular shape. The panel has a medial portion having a generally opaque mark thereon. The opaque mark has a generally circular shape. The opaque mark has a hole therein. The hole is positioned in a central portion of the opaque mark. The panel comprises a flexible material. The back side of the panel is adapted for removably securing to a lens. The panel is coupled to the rear lens of a gun scope.

7 Claims, 4 Drawing Sheets

GUN SCOPE OVERLAY DEVICE

BACKGROUND OF THE INVENTION

1. Field of the Invention

The present invention relates to gun scope devices and more particularly pertains to a new gun scope overlay device for diminishing the parallax affect when using a gun scope.

2. Description of the Prior Art

The use of gun scope devices is known in the prior art. More specifically, gun scope devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,896,581; 1,869,385; 4,718,962; U.S. Des. Pat. No. 48,618; U.S. Des. Pat. No. 296,838; and Des. U.S. Pat. No. 403,774.

While these devices fulfill their respective, particular objectives and requirements, the aforementioned patents do not disclose a new gun scope overlay device. The inventive device includes a panel. The panel has a front side and a back side. The panel is substantially transparent. The panel has a generally circular shape. The panel has a medial portion having a generally opaque mark thereon. The opaque mark has a generally circular shape. The opaque mark has a hole therein. The hole is positioned in a central portion of the opaque mark. The panel comprises a flexible material. The back side of the panel is adapted for removably securing to a lens. The panel is coupled to the rear lens of a gun scope.

In these respects, the gun scope overlay device according to the present invention substantially departs from the conventional concepts and designs of the prior art, and in so doing provides an apparatus primarily developed for the purpose of diminishing the parallax affect when using a gun scope.

SUMMARY OF THE INVENTION

In view of the foregoing disadvantages inherent in the known types of gun scope devices now present in the prior art, the present invention provides a new gun scope overlay device construction wherein the same can be utilized for diminishing the parallax affect when using a gun scope.

The general purpose of the present invention, which will be described subsequently in greater detail, is to provide a new gun scope overlay device apparatus and method which has many of the advantages of the gun scope devices mentioned heretofore and many novel features that result in a new gun scope overlay device which is not anticipated, rendered obvious, suggested, or even implied by any of the prior art gun scope devices, either alone or in any combination thereof.

To attain this, the present invention generally comprises a panel. The panel has a front side and a back side. The panel is substantially transparent. The panel has a generally circular shape. The panel has a medial portion having a generally opaque mark thereon. The opaque mark has a generally circular shape. The opaque mark has a hole therein. The hole is positioned in a central portion of the opaque mark. The panel comprises a flexible material. The back side of the panel is adapted for removably securing to a lens. The panel is coupled to the rear lens of a gun scope.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gun scope overlay device apparatus and method which has many of the advantages of the gun scope devices mentioned heretofore and many novel features that result in a new gun scope overlay device which is not anticipated, rendered obvious, suggested, or even implied by any of the prior art gun scope devices, either alone or in any combination thereof.

It is another object of the present invention to provide a new gun scope overlay device which may be easily and efficiently manufactured and marketed.

It is a further object of the present invention to provide a new gun scope overlay device which is of a durable and reliable construction.

An even further object of the present invention is to provide a new gun scope overlay device which is susceptible of a low cost of manufacture with regard to both materials and labor, and which accordingly is then susceptible of low prices of sale to the consuming public, thereby making such gun scope overlay device economically available to the buying public.

Still yet another object of the present invention is to provide a new gun scope overlay device which provides in the apparatuses and methods of the prior art some of the advantages thereof, while simultaneously overcoming some of the disadvantages normally associated therewith.

Still another object of the present invention is to provide a new gun scope overlay device for diminishing the parallax affect when using a gun scope.

Yet another object of the present invention is to provide a new gun scope overlay device which includes a panel. The panel has a front side and a back side. The panel is substantially transparent. The panel has a generally circular shape. The panel has a medial portion having a generally opaque mark thereon. The opaque mark has a generally circular shape. The opaque mark has a hole therein. The hole is positioned in a central portion of the opaque mark. The panel comprises a flexible material. The back side of the panel is adapted for removably securing to a lens. The panel is coupled to the rear lens of a gun scope.

Still yet another object of the present invention is to provide a new gun scope overlay device that is retrofittable to existing gun scopes.

Even still another object of the present invention is to provide a new gun scope overlay device that is easily places on gun scopes without the need for tools or complicated actions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
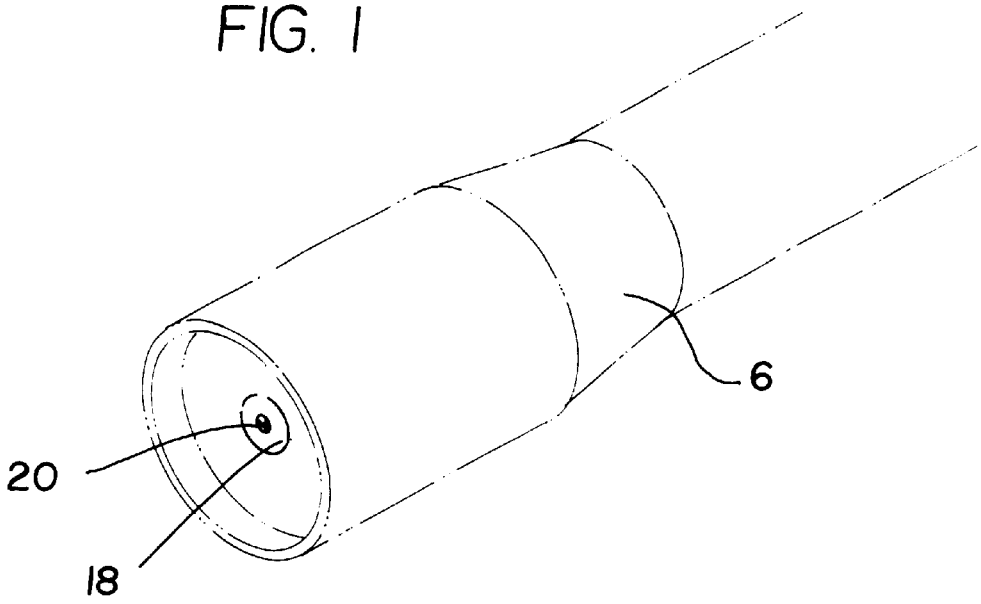
FIG. 1 is a schematic perspective view of a new gun scope overlay device according to the present invention.
Figure 2:
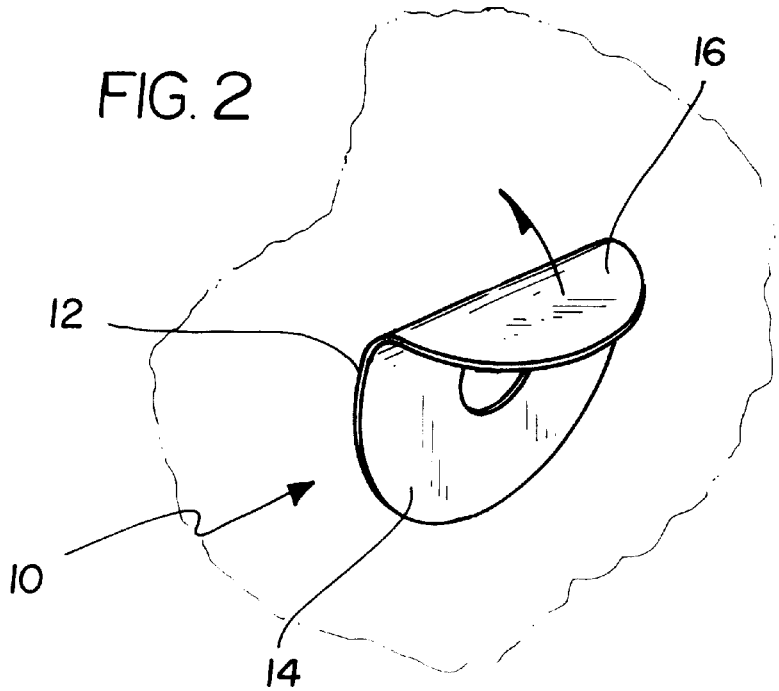
FIG. 2 is a schematic perspective view of the present invention.

With reference now to the drawings, and in particular to FIGS. 1 through 6 thereof, a new gun scope overlay device embodying the principles and concepts of the present invention and generally designated by the reference numeral 10 will be described.

As best illustrated in FIGS. 1 through 6, the gun scope overlay device 10 generally comprises a panel 12. The panel 12 has a front side 14 and a back side 16. The panel is substantially transparent. The panel has a generally circular shape. The panel has a medial portion having a generally opaque mark 18 thereon. The opaque mark 18 has a generally circular shape. The opaque mark 18 has a hole 20 therein. The hole 20 is positioned in a central portion of the opaque mark 18. The panel 12 comprises a flexible material. The flexible material ideally comprises a plastic material. The back side 16 is adapted for removably securing to a lens. The back side 16 has an adhesive thereon. Perforated cutouts 22 may be provided for differing sized opaque marks which may be placed on the panel.

A mounting means mounts the panel on the gun scope 6 if the panel 12 is not directly placed on the rear lens 8 of the gun scope 6. The rear lens 8 being the lens nearer the eye of the user. The mounting means includes an annular member 24. The annular member 24 has a generally cylindrical shape. The annular member has an inner diameter substantially equal to an outer diameter of the gun scope 6. The annular member 24 is mounted on the gun scope 6 substantially adjacent to the rear lens 8. The size of the annular member 24 depends on the size of the scope 6.

A bracket 26 is integrally coupled to an outer surface of the annular member. The bracket 26 mounted directly to the scope in FIG. 3A.

Figure 3A:
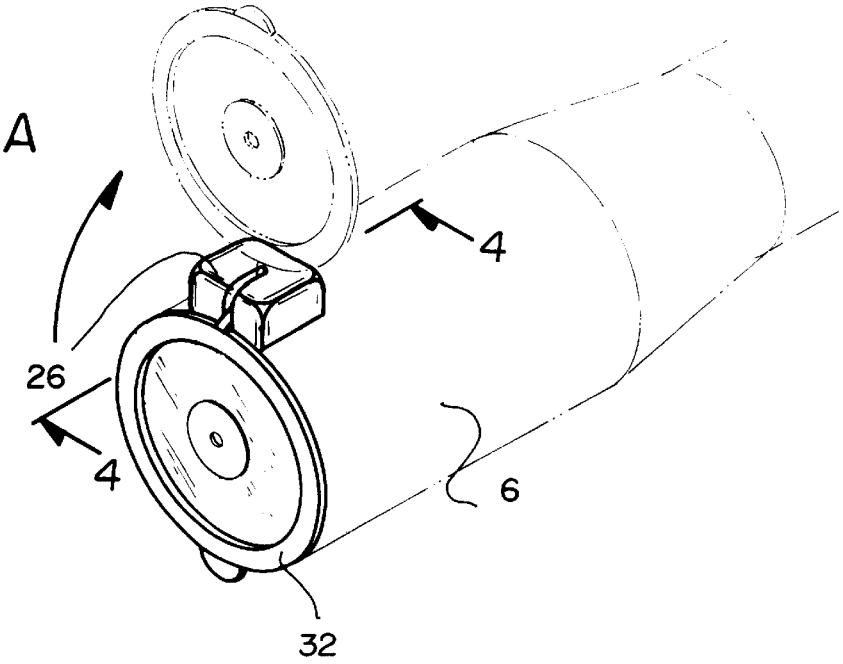
FIG. 3A is a schematic perspective view of a mounting means of the present invention.
Figure 4:
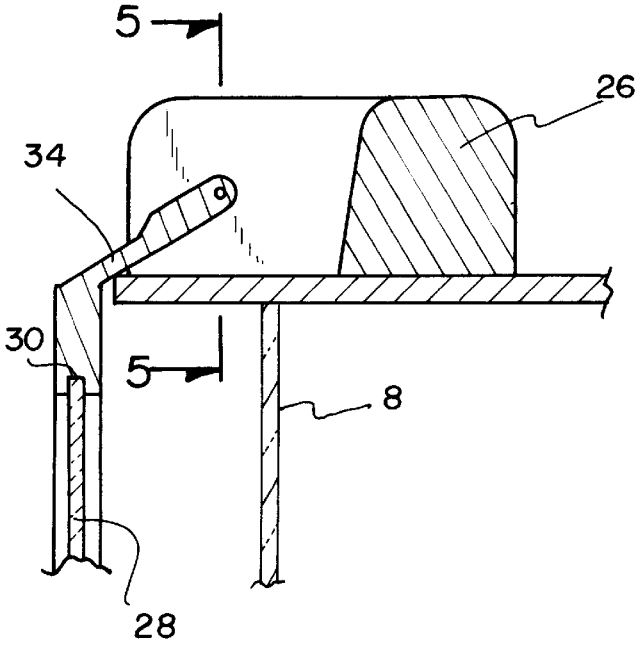
FIG. 4 is a schematic cross-sectional view taken along line 4—4 of the present invention.
Figure 5:
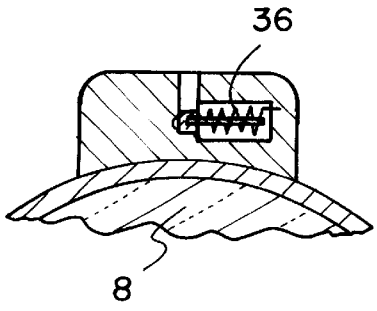
FIG. 5 is a schematic cross-sectional view taken along line 5—5 of the present invention.
Figure 3B:
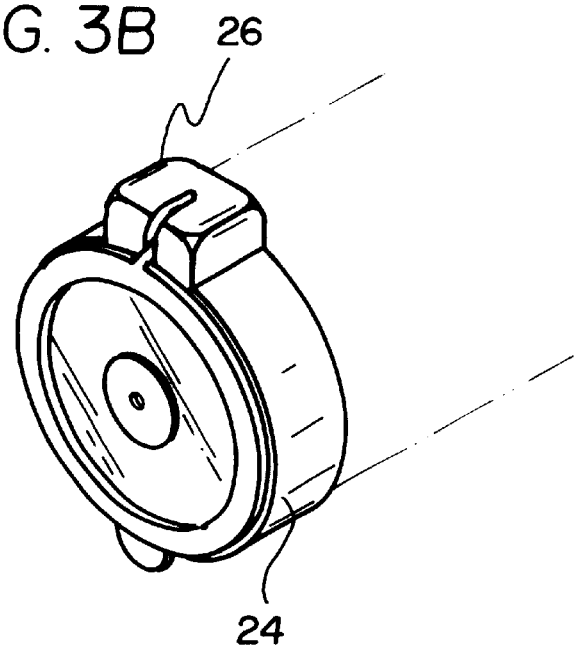
FIG. 3B is a schematic perspective view of a mounting means of the present invention.
Figure 3C:
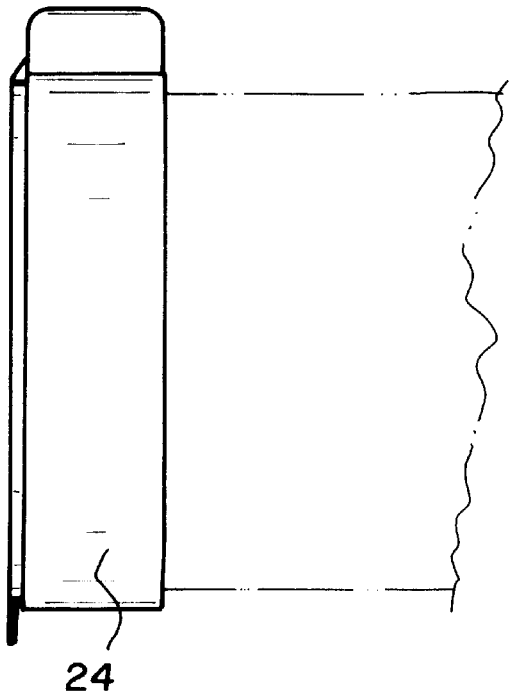
FIG. 3C is a schematic side view of a mounting means of the present invention.
Figure 6:
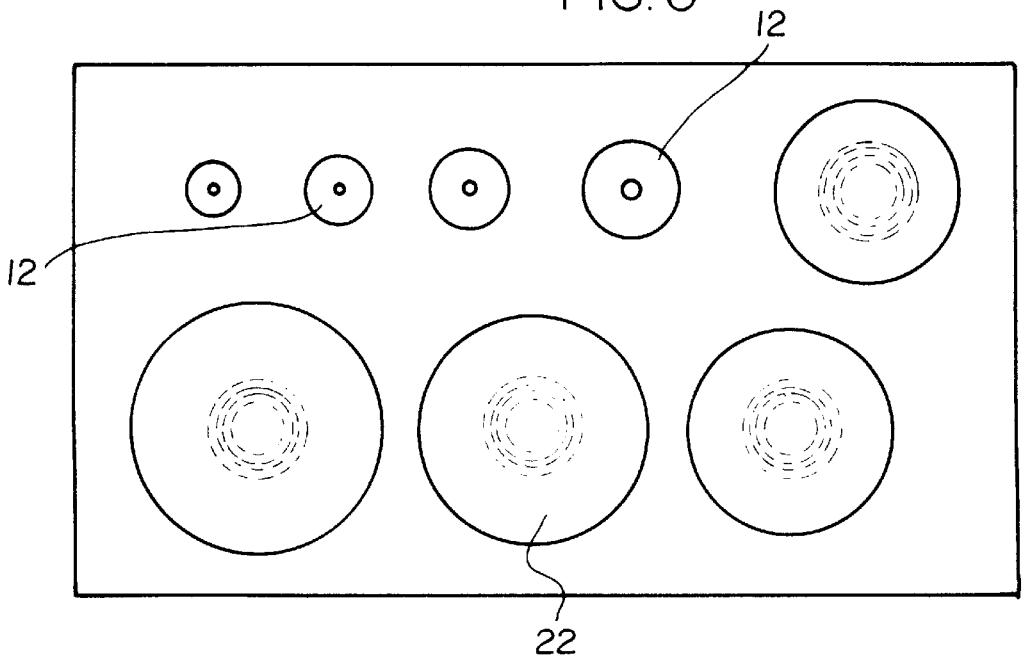
FIG. 6 is a schematic plan view of a plurality of panels of the present invention.

A lens 28, having a generally circular shape, has a peripheral edge 30 having a frame 32 fixedly coupled thereto. The frame 32 has a protruding member 34 thereon. The protruding member 34 is pivotally coupled to the bracket 26 such that the lens 28 may be selectively positioned parallel to and covering or away from the rear lens 8 of the gun scope 6 as depicted in FIG. 3A. A biasing 36 means biases the lens 28 in a parallel orientation to the rear lens 8. The biasing means 36 preferably comprises a spring.

In use, the panel 12 is placed centrally on the lens 28 with the adhesive backing on the lens 28. The lens 28 is then positioned over the rear sight 8 and the gun sight is sighted in. If the mounting means is not utilized, the panel 12 may be placed directly over the rear lens 8. The opaque mark 18 allows the user to sight their rifle while minimizing the parallax affect caused by a change to the line of eyesight if the eye of the user is not in the same position on every shot of the rifle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gun scope overlay device for improving accuracy of a rifle, said device being removably mountable over the rear lens of a gun scope, said device comprising:

a panel, said panel having a front side and a back side, said panel being substantially transparent, said panel having a generally circular shape, said panel having a medial portion having a generally opaque mark thereon, said opaque mark having a generally circular shape, said opaque mark having a hole therein, said hole being positioned in a central portion of said opaque mark, said panel comprising a flexible material, said back side being adapted for removably securing to a lens, wherein said panel is coupled to said rear lens.

2. The gun scope overlay device as in claim 1, further comprising:

a plurality of panels, each of said panels having a different sized opaque mark thereon.

3. A gun scope overlay device for improving accuracy of a rifle, said device being removably mountable over the rear lens of a gun scope, said device comprising:

a panel, said panel having a front side and a back side, said panel being substantially transparent, said panel having a generally circular shape, said panel having a medial portion having a generally opaque mark thereon, said opaque mark having a generally circular shape, said opaque mark having a hole therein, said hole being positioned in a central portion of said opaque mark, said panel comprising a flexible material, said back side being adapted for removably securing to a lens;

a mounting means for mounting said panel on the gun scope, said mounting means comprising:

a lens pivotally mounted to said gun scope and over said rear lens, wherein said panel is coupled to said lens.

4. The gun scope overlay device as in claim 3, wherein said mounting means further comprises:

an annular member, said annular member having a generally cylindrical shape, said annular member having an inner diameter substantially equal to an outer diameter of the gun scope, wherein the annular member is mounted on the gun scope substantially adjacent to the rear lens;

a bracket, said bracket being integrally coupled to an outer surface of said annular member; and said lens having a generally circular shape, said lens having a peripheral edge having a frame fixedly coupled thereto, said frame having a protruding member thereon, said protruding member being pivotally coupled to said bracket such that said lens may be selectively positioned parallel to and covering or away from the rear lens of the gun scope.

5. A gun scope overlay device as in claim 4, wherein said mounting means further comprises:

a biasing means for biasing said lens in a parallel orientation to said rear lens, said biasing means comprising a spring.

6. A gun scope overlay device as in claim 3, wherein said mounting means further comprises:

a bracket, said bracket being integrally coupled to an outer surface of the gun scope and positioned generally adjacent to said rear lens; and said lens having a generally circular shape, said lens having a peripheral edge having a frame fixedly coupled thereto, said frame having a protruding member thereon, said protruding member being pivotally coupled to said bracket such that said lens may be selectively positioned parallel to and covering or away from the rear lens of the gun scope.

7. A gun scope overlay device for improving accuracy of a rifle, said device being removably mountable over the rear lens of a gun scope, said device comprising:

a panel, said panel having a front side and a back side, said panel being substantially transparent, said panel having a generally circular shape, said panel having a medial portion having a generally opaque mark thereon, said opaque mark having a generally circular shape, said opaque mark having a hole therein, said hole being positioned in a central portion of said opaque mark, said panel comprising a flexible material, said flexible material comprising a plastic material, said back side being adapted for removably securing to a lens, said back side having an adhesive thereon;

a mounting means for mounting said panel on the gun scope, said mounting means comprising:

an annular member, said annular member having a generally cylindrical shape, said annular member having an inner diameter substantially equal to an outer diameter of the gun scope, wherein the annular member is mounted on the gun scope substantially adjacent to the rear lens;

a bracket, said bracket being integrally coupled to an outer surface of said annular member;

a lens, said lens having a generally circular shape, said lens having a peripheral edge having a frame fixedly coupled thereto, said frame having a protruding member thereon, said protruding member being pivotally coupled to said bracket such that said lens may be selectively positioned parallel to and covering or away from the rear lens of the gun scope;

a biasing means for biasing said lens in a parallel orientation to said rear lens, said biasing means comprising a spring; and wherein said panel may by placed centrally on said lens.

* * * * *